US005281308A

United States Patent [19]

Lauterbach

[11] Patent Number: 5,281,308

[45] Date of Patent: Jan. 25, 1994

[54] PICK-UP ROLL APPARATUS

[75] Inventor: Thomas J. Lauterbach, Kalamazoo, Mich.

[73] Assignee: Beloit Technologies, Inc., Wilmington, Del.

[21] Appl. No.: 871,319

[22] Filed: Apr. 20, 1992

[51] Int. Cl.[5] ..... D21F 3/10

[52] U.S. Cl. ..... 162/306; 162/193; 162/370

[58] Field of Search ..... 162/368-372, 162/193, 194, 286, 306

[56] References Cited

U.S. PATENT DOCUMENTS

| | | | |
|---|---|---|---|
| 2,714,342 | 8/1955 | Beachler | 162/370 |
| 2,857,822 | 10/1958 | Heys | 162/306 |
| 4,980,979 | 1/1991 | Wedel | 162/370 |
| 5,015,336 | 4/1991 | Roerig et al. | 162/370 |
| 5,135,614 | 8/1992 | Aula et al. | 162/370 |

FOREIGN PATENT DOCUMENTS

| | | |
|---|---|---|
| 733242 | 7/1955 | United Kingdom . |
| 775206 | 5/1957 | United Kingdom . |

*Primary Examiner*—Karen M. Hastings

*Attorney, Agent, or Firm*—Dirk J. Veneman; Raymond W. Campbell; David J. Archer

[57] ABSTRACT

A pick-up roll apparatus is disclosed for picking up a tail of a web from a forming wire and for transferring the tail to a press felt wrapping around a portion of the apparatus. The apparatus includes a perforate rotatable shell which is disposed adjacent to the forming wire, the shell having a first and a second end. A stationary core is disposed within the shell, the core defining a tail box which is bounded by the shell. The tail box is disposed adjacent to one of the ends of the shell and is selectively connected to a source of partial vacuum such that when the tail of the web is cut on the forming wire, the tail is drawn from the forming wire onto the press felt which wraps around the rotatable shell. The core also defines a downstream chamber which extends between the first end and the second end of the shell. The chamber is bounded by the sheli and is connected to the source of vacuum such that during widening of the tail to a full-width sheet, a flow of air through the press felt and through the perforate shell towards the downstream chamber urges the widened tail towards the press felt. The tail box and the downstream chamber are in fluid communication with each other so that any tendency of the tail to detach from the press felt in the vicinity of the tail box during the widening of the tail is inhibited.

4 Claims, 3 Drawing Sheets

PICK-UP ROLL APPARATUS

BACKGROUND OF THE INVENTION

1. Field of the Invention

The present invention relates to a pick-up roll apparatus for picking up a tail of a web from a forming wire. More particularly, the present invention relates to a pick-up roll apparatus which transfers the tail to a press felt which wraps around a portion of the pick-up roll apparatus.

2. Information Disclosure Statement

In the papermaking art, a web is formed on a fourdrinier wire by ejecting stock onto the wire and draining water from the stock through the wire.

Subsequently, the partially dewatered web is transferred from the fourdrinier forming wire onto a press felt where the web is conveyed between counter-rotating press rolls, or the like, for further dewatering the web.

Typically, the transfer from the forming wire to a press felt is accomplished by means of a pick-up roll, which is disposed closely adjacent to the forming wire. The press felt wraps around a portion of the pick-up roll such that the formed web is disposed between the fourdrinier wire and the press felt.

In many pick-up rolls, a central core of the pick-up roll defines a full-width chamber having an open face towards that portion of the pick-up roll wrapped by the press felt. The chamber which extends in a cross-machine direction is connected to a source of partial vacuum, and the core rotatably supports a perforate roll shell such that as the press felt extends around and wraps the pick-up roll shell, the roll shell rotates relative to the pick-up chamber. When the pick-up chamber is connected to the source of partial vacuum, the full-width sheet is pulled towards the press felt so that a transfer of the full-width sheet to the press felt is effected.

More recently, pick-up rolls have been proposed which include not only a pick-up chamber, but also a tail box or end box disposed adjacent to one edge of the web. The tail box, which is usually approximately six inches in width, is connected to a source of partial vacuum so that during a transfer operation, a tail cutter disposed upstream relative to the pick-up roll cuts a six inch wide tail from the formed web.

When the tail has been cut, both the tail and the remainder of the full-width sheet are discharged to a broke pit disposed beneath the fourdrinier wire.

The vacuum source is then connected to the tail box so that the tail is drawn towards the press felt by the vacuum in the tail box, and the tail is guided by the press felt through the press section.

Once the tail has been stabilized through the press section, the tail cutter is moved in a cross-machine direction across the forming wire such that the tail is widened to a full-width sheet.

In view of the movement of the formed web and the cross-machine directional movement of the tail cutter, the tail is widened and assumes a diagonal leading edge until the tail cutter completes movement across the web.

However, such prior tail threading operations have always been accomplished by turning off the vacuum supply to the tail box and by then turning on the vacuum supply to the cross-machine directional vacuum chamber during the tail widening operation.

Consequently, a problem has existed in that when the vacuum to the tail box is turned off, there exists a tendency for that edge of the web adjacent to the tail box to drop off of the press felt while the remainder of the tail, which is being widened to a full-width sheet, is being supported by the cross-machine directional vacuum chamber.

The present invention overcome the aforementioned problem by the provision of a downstream chamber which is connected to the same source of vacuum as the tail box so that during the tail widening step, a relatively low vacuum is applied along the entire cross-machine directional width of the widened tail, including that portion of the tail moving over the tail box.

When the tail has been widened to a full-width sheet, a relatively high vacuum is applied through an upstream vacuum chamber defined by the core for maintaining the transfer of the full-width sheet to the press felt.

Therefore, the present invention overcomes the aforementioned inadequacies of the prior art arrangements and provides a pick-up roll apparatus which makes a considerable contribution to the art of transferring a tail of a web from a forming section to a press section.

Another object of the present invention is the provision of a pick-up roll apparatus which includes a downstream vacuum chamber which is connected to a tail box for controlling the transfer of a tail from a forming wire onto a press felt while the tail is being widened to a full-width sheet.

Other objects and advantages of the present invention will be readily apparent to those skilled in the art by a consideration of the detailed description contained hereinafter, taken in conjunction with the annexed drawings.

SUMMARY OF THE INVENTION

A pick-up roll apparatus and method is disclosed for picking up a tail of a web from a forming wire and for transferring the tail to a press felt wrapped around a portion of the apparatus.

The pick-up roll apparatus includes a perforate rotatable shell which is disposed adjacent to the forming wire, the shell having a first and a second end.

A stationary core is disposed within the shell, the core defines a tail box which is bounded by the shell. The tail box is disposed adjacent to one of the ends of the shell with the tail box being selectively connected to a source of partial vacuum such that when the tail of the web is cut on the forming wire, the tail is drawn from the forming wire onto the press felt, which wraps around the rotatable shell.

The core also defines a downstream chamber which extends between the first and the second end of the shell. The chamber is bounded by the shell and is connected to the source of vacuum such that during widening of the tail to a full-width sheet, a flow of air through the press felt and through the perforate shell towards the downstream chamber urges the widened tail towards the press felt. The tail box and the downstream chamber are in fluid communication with each other so that any tendency for the tail to detach from the press felt in the vicinity of the tail box during the widening of the tail is inhibited.

In a more specific embodiment of the present invention, the rotatable shell defines an inner and an outer surface. The shell also defines a plurality of holes with each hole extending from the inner to the outer surface, the holes being located over the entire outer surface of the shell.

The stationary core also includes a first and a second journal which are disposed respectively in the vicinity of the first and the second end of the rotatable shell for rotatably supporting the shell such that the shell is permitted to rotate relative to the core.

The tail box is sector-shaped and has an open face towards a portion of the shell which is wrapped by the press felt. The arrangement is such that during a tail threading operation, when the tail has been cut, vacuum is applied to the tail box for generating a current of air which flows towards the tail box for drawing the tail from the forming wire onto the press felt as the press felts wraps the perforate shell.

The downstream chamber is disposed adjacent to a portion of the rotatable shell, which is wrapped by the press felt and is disposed immediately upstream from where the press felt diverges from the shell following the wrapped portion.

The core also includes an upstream chamber which extends between the first and the second end of the shell. The upstream chamber is disposed upstream relative to the downstream chamber and is connected to a further source of partial vacuum. The arrangement is such that when the tail has been widened to a full-width sheet, the upstream chamber is connected to the further source of vacuum for urging the full-width sheet away from the forming wire and towards the press felt so that the full-width sheet is transferred from the forming onto the press felt.

The further source of partial vacuum is at a higher vacuum level than the source of vacuum applied to the tail box and the downstream chamber.

Many modifications and variations of the present invention will be readily apparent to those skilled in the art by a consideration of the detailed description contained hereinafter, taken in conjunction with the annexed drawings.

However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
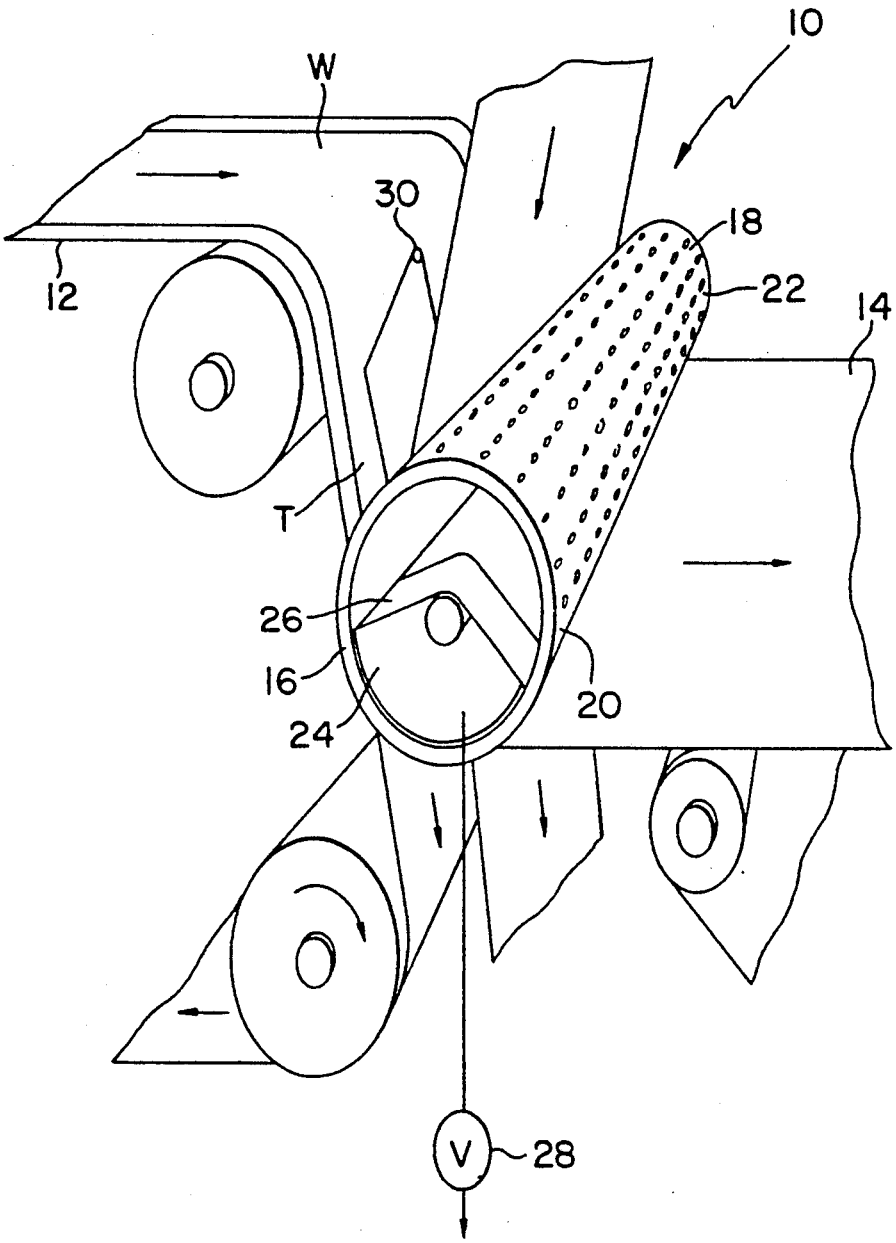
FIG. 1 is a perspective view of a pick-up roll apparatus according to the present invention.

FIG. 1 is a perspective view of a pick-up roll apparatus, generally designated 10 according to the present invention, for picking up a tail T of a web W from a forming wire 12 and for transferring the tail T to a press felt 14 which wraps around a portion 16 of the apparatus 10.

The apparatus 10 includes a rotatable shell 18 which is disposed adjacent to the forming wire 12. The shell 18 has a first and a second end 20 and 22, respectively.

A stationary core 24 is disposed within the shell 18. The core 24 defines a tail box 26 which is bounded by the shell 18. The tail box 26 is disposed adjacent to the end 20 of the shell 18. The tail box 26 is selectively connected to a source of partial vacuum 28 such that when the tail T of the web W is cut on the forming wire 12 by a tail cutter, generally designated 30, the tail T is drawn from the forming wire 12 onto the press felt 14, which wraps around the rotatable shell 18.

Figure 2:
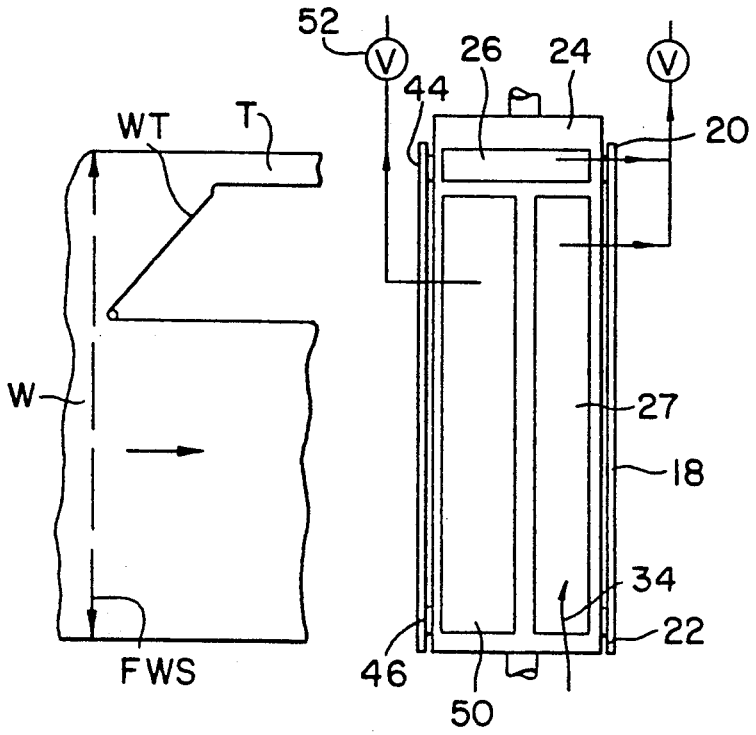
FIG. 2 is a diagrammatic representation viewed from beneath the vacuum roll apparatus shown in FIG. 1.

FIG. 2 is a diagrammatic representation viewed from beneath the vacuum roll apparatus 10 showing the tail box 26 which cooperates with the tail T of the web W. As shown in FIG. 2, the core 24 also defines a downstream chamber 27 which extends between the first and second ends 20 and 22 of the shell 18. The chamber 27 is bounded by the shell 18 and is connected to the source of partial vacuum 28. The arrangement is such that during widening of the tail T to a full-width sheet, as indicated by the arrow FWS, a flow of air, as indicated by the arrow 34, through the press felt 14 and through the perforate shell 18 towards the downstream chamber 27 urges the widened tail WT towards the press felt 14. The tail box 26 and the downstream chamber 27 are in fluid communication with each other so that any tendency for the tail T to detach from the pres felt 14 in the vicinity of the tail box 26 during the widening of the tail T is inhibited.

Figure 3:
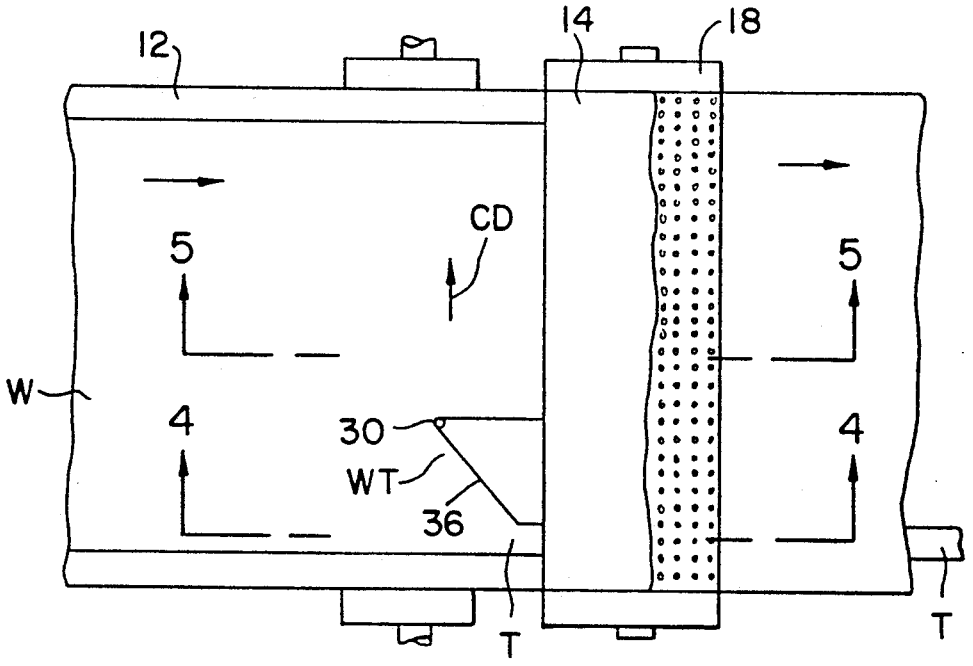
FIG. 3 is a top plan view of the apparatus shown in FIG. 1.

FIG. 3 is a top plan view of the apparatus 10 and shows the tail cutter 30 moving in a cross-machine direction CD, thereby producing a diagonal leading edge 36 on the widened tail WT.

Figure 4:
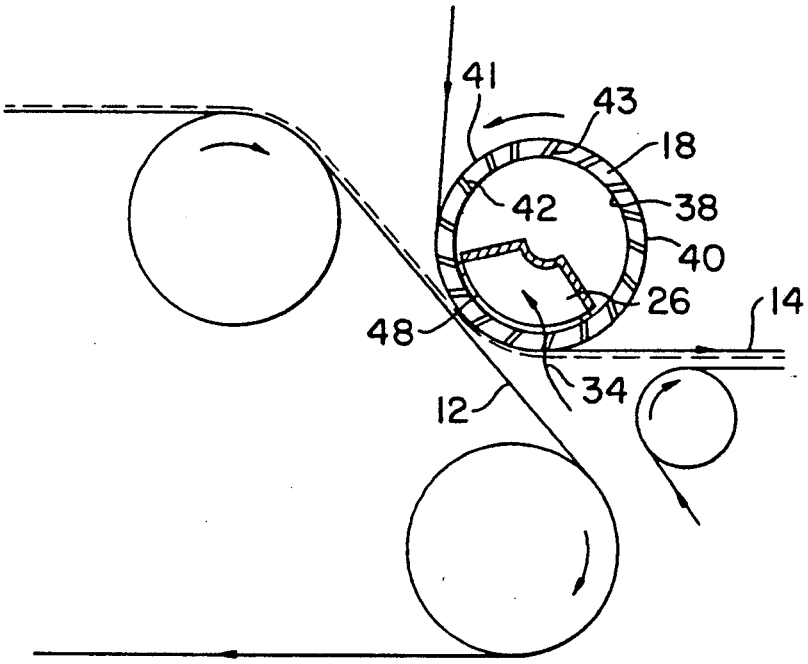
FIG. 4 is a sectional view taken on the line 4—4 of FIG. 3.

FIG. 4 is a sectional view taken on the line 4-4 of FIG. 3. FIG. 4 shows the rotatable shell 18 defining an inner and an outer surface 38 and 40, respectively. The shell 18 also defines a plurality of holes 41,42 and 43 with each hole extending from the inner surface 38 to the outer surface 40. The holes 41 to 43 are located over the entire outer surface of the shell 18.

FIG. 2 shows the stationary core 24 as further including a first and second journal 44 and 46, respectively, which are disposed respectively in the vicinity of the first and second end 20 and 22 of the rotatable shell 18 for rotatably supporting the shell 18 such that the shell 18 is permitted to rotate relative to the core 24.

FIG. 4 shows the tail box 26 having a sector-like shape and having an open face 48 facing towards a portion 16 of the shell 18 wrapped by the press felt 14. The arrangement is such that during a tail threading operation, when the tail T has been cut, vacuum is applied to the tail box 26 for generating a current of air, as indicated by the arrow 34, so that the current of air flows towards the tail box 26 for drawing the tail T from the forming wire 12 onto the press felt 14 as the press felt 14 wraps the perforate shell 18.

Figure 5:
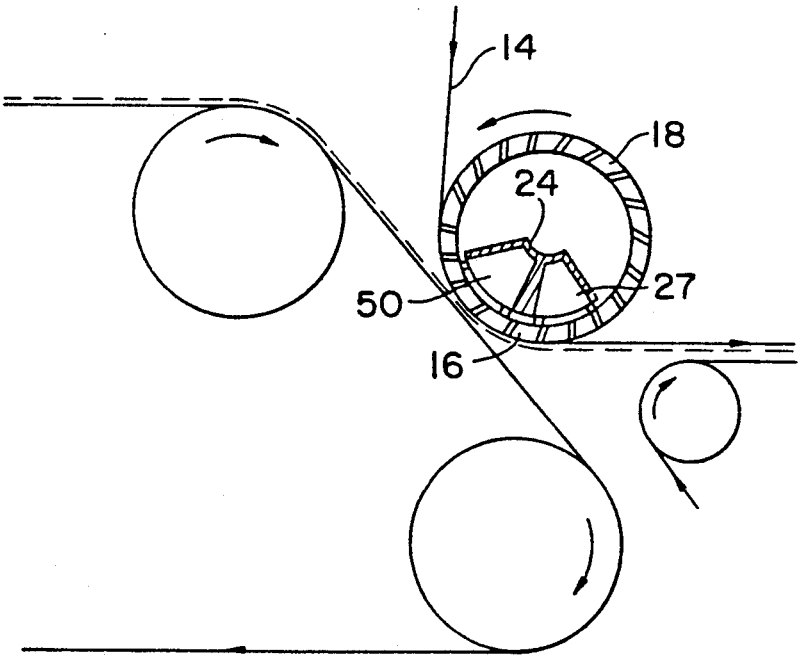
FIG. 5 is a sectional view taken on the line 5—5 of FIG. 3.

FIG. 5 is a sectional view taken on the line 5—5 of FIG. 3 and shows the downstream chamber 27 disposed adjacent to the portion 16 of the rotatable shell 18 wrapped by the press felt 14. The downstream chamber 27 is disposed immediately upstream from where the press felt 14 diverges from the shell 18 following the wrapped portion 16.

As shown in FIG. 5, the core 24 also defines an upstream chamber 50. The upstream chamber 50 extends between the first and second ends 20 and 22, respectively, of the shell 18. The upstream chamber 50 is disposed upstream relative to the downstream chamber 27. The upstream chamber 50 is connected to a further source of partial vacuum 52. The downstream chamber 27 and upstream chamber 50 are each sector-shaped. As can be seen in FIGS. 2, 4 and 5, the cross section of the sector defined by the tail box 26 is substantially equal to the total cross section of the sectors defined by both the downstream chamber 27 and the upstream chamber 50. The arrangement is such that when the tail T has been widened to a full-width sheet FWS, the upstream chamber 50 is connected to the further source of vacuum 52 for urging the full-width sheet FWS away from the forming wire 12 and towards the press felt 14 so that the full-width sheet FWS is transferred from the forming wire 12 onto the press felt 14.

The further source of partial vacuum 52 is at a higher vacuum level than the source of vacuum 28 applied to the tail box 26 and the downstream chamber 27.

The present invention provides a vacuum pick-up roll which overcomes the problem of edge detachment during a tail widening operation.

What is claimed is:

1. In a papermaking machine having a press felt, a pick-up roll apparatus for picking up a tail of a web from a forming wire and for transferring the tail to said press felt wrapping around a portion of the apparatus, said apparatus comprising:

a perforate rotatable shell disposed adjacent to the forming wire, said shell having a first and a second end;

a stationary core disposed within said shell, said core defining a tail box which is bounded by said shell, said tail box being sector-shaped and disposed adjacent to one end of said ends of said shell, said tail box being selectively connected to a source of partial vacuum such that when the tail of the web is cut on the forming wire, the tail is drawn from the forming wire onto the press felt which wraps around said rotatable shell;

said core also defining a chamber extending between said first and said second end of said shell, said chamber being bounded by said shell, said chamber being connected to said source of partial vacuum such that during widening of the tail to a full width sheet, a flow of air through the press felt and through said perforate shell towards said chamber urges the widened tail towards the press felt, said tail box and said chamber being in fluid communication with each other so that during a tail widening operation, the vacuum is applied simultaneously to said tail box and to said chamber, the arrangement being such that any tendency for the tail to detach from the press felt in the vicinity of said tail box during the widening of the tail is inhibited;

said core further defining an upstream chamber;

said upstream chamber extending between said first and said second ends of said shell, said upstream chamber being disposed upstream relative to said chamber, said upstream chamber being connected to a further source of partial vacuum different from said source of partial vacuum, the arrangement being such that when the tail has been widened to a full width sheet, the upstream chamber is connected to said further source of vacuum for urging the full width sheet away from the forming wire and towards the press felt so that the full width sheet is transferred from the forming wire onto the press felt, said chamber and said upstream chamber each being sector-shaped, with the cross section of the sector defined by the tail box being substantially equal to the total cross section of the sectors defined by both said chamber and said upstream chamber; and said further source of partial vacuum being at a higher vacuum level than said source of partial vacuum applied to said tail box and said chamber for urging the web towards the press felt during widening of the tail to a full width web.

2. A pick-up roll apparatus as set forth in claim 1, wherein said rotatable shell defines an inner and an outer surface, said shell also defining a plurality of holes, each hole extending from said inner to said outer surface, said holes being located over the entire outer surface of said shell.

3. A pick-up roll apparatus as set forth in claim 1, wherein said stationary core further includes:

a first and a second journal disposed respectively in the vicinity of said first and second end of said rotatable shell for rotatably supporting said shell such that said shell is permitted to rotate relative to said core.

4. A pick-up roll apparatus as set forth in claim 1, wherein said chamber is disposed adjacent to a portion of said rotatable shell wrapped by the press felt and immediately upstream from where the press felt diverges from said shell following said wrapped portion.

* * * * *

UNITED STATES PATENT AND TRADEMARK OFFICE

CERTIFICATE OF CORRECTION

PATENT NO. : 5,281,308
DATED : January 25, 1994
INVENTOR(S) : Thomas J. Lauterbach It is certified that error appears in the above-indentified patent and that said Letters Patent is hereby corrected as shown below:

Column 2, Line 10: Please delete "overcome" and insert --overcomes-- in place thereof.

Column 4, Line 28: Please delete "pres" and insert --press-- in place thereof.

Signed and Sealed this

Ninth Day of August, 1994

Bruce Lehman

*Attest:*

BRUCE LEHMAN

*Attesting Officer*

*Commissioner of Patents and Trademarks*